US011264761B2

(12) United States Patent
Hedrick et al.

(10) Patent No.: US 11,264,761 B2
(45) Date of Patent: Mar. 1, 2022

(54) SPACER AND TETHER DEVICE FOR ADAPTING A MULTICONDUCTOR PLUG

(71) Applicant: Atlantic Signal, LLC, Topeka, KS (US)

(72) Inventors: Randall Blake Hedrick, Topeka, KS (US); David John Bondarenko, Topeka, KS (US); Eric Ryan Jones, Topeka, KS (US)

(73) Assignee: Atlantic Signal, LLC, Topeka, KS (US)

( * ) Notice: Subject to any disclaimer, the term of this patent is extended or adjusted under 35 U.S.C. 154(b) by 0 days.

(21) Appl. No.: 16/938,153

(22) Filed: Jul. 24, 2020

(65) Prior Publication Data

US 2021/0028577 A1 Jan. 28, 2021

Related U.S. Application Data

(60) Provisional application No. 62/878,556, filed on Jul. 25, 2019.

(51) Int. Cl.
*H01R 13/631* (2006.01)
*H01R 24/58* (2011.01)

(52) U.S. Cl.
CPC ..... *H01R 13/631* (2013.01); *H01R 24/58* (2013.01)

(58) Field of Classification Search
CPC ..... H01R 13/631; H01R 24/58
See application file for complete search history.

(56) References Cited

U.S. PATENT DOCUMENTS

| | | | | |
|---|---|---|---|---|
| D370,401 | S * | 6/1996 | Minkin | D8/333 |
| 6,973,809 | B2 * | 12/2005 | Chang | E05B 73/0082 70/14 |
| 7,299,668 | B1 * | 11/2007 | Lu | E05B 73/0082 70/14 |
| 7,302,816 | B1 * | 12/2007 | Lu | E05B 73/0082 70/14 |
| 8,139,809 | B2 * | 3/2012 | Jubelirer | H04R 1/10 381/385 |
| 8,935,943 | B2 * | 1/2015 | Derman | E05B 73/0082 70/14 |
| 9,107,004 | B2 * | 8/2015 | Hedrick | H04R 1/46 |
| 9,433,464 | B2 * | 9/2016 | Grunewald | A61B 18/1492 |
| D786,047 | S * | 5/2017 | Mack | D8/333 |
| D882,373 | S * | 4/2020 | Baum | D8/333 |
| 10,689,886 | B2 * | 6/2020 | Mack | F41C 33/06 |
| D918,875 | S * | 5/2021 | Yu | D14/225 |
| 2013/0202135 | A1 * | 8/2013 | Hedrick | H04R 1/46 381/151 |

(Continued)

*Primary Examiner* — Abdullah A Riyami
*Assistant Examiner* — Nader J Alhawamdeh
(74) *Attorney, Agent, or Firm* — Avek IP, LLC; Kent R. Erickson

(57) ABSTRACT

A spacer and tether device for adapting a multiconductor plug includes a spacer configured to position a plug having multiple conductors at a predetermined distance from a jack having fewer conductors so that one or more conductors of the plug are not inserted into the jack, allowing the remaining conductors of the plug to properly align with the conductors in the jack. A tether attaches at one end to the spacer and at an opposite end to the housing of the plug so that the spacer is secured to the plug for use when required.

20 Claims, 4 Drawing Sheets

(56) References Cited

U.S. PATENT DOCUMENTS

| | | | | |
|---|---|---|---|---|
| 2014/0157839 | A1* | 6/2014 | Theobald | H01R 13/639 70/58 |
| 2018/0372446 | A1* | 12/2018 | Mack | E05B 73/0005 |
| 2020/0032558 | A1* | 1/2020 | Mack | F41C 33/06 |
| 2021/0028577 | A1* | 1/2021 | Hedrick | H01R 24/58 |

* cited by examiner

SPACER AND TETHER DEVICE FOR ADAPTING A MULTICONDUCTOR PLUG

CROSS-REFERENCE TO RELATED APPLICATIONS

This application claims the benefit of U.S. Provisional Patent Application No. 62/878,556, filed Jul. 25, 2020, the disclosure of which is hereby incorporated herein in its entirety by reference.

BACKGROUND

Multiconductor electrical plugs and jacks are known in the art and are commonly used to facilitate electrical connections between the electrically conductive wires of two cables. With the multiconductor plugs and jacks connected together, the individual wires of a first cable are conductively connected, through the plug and jack, to individual wires of a second cable. The plug and jack configuration thus allows easy connection of, for example, a plug on a headset/microphone device to a jack on a communications device, computer, or the like.

One common configuration of a multiconductor plug for audio connections is a cylindrical plug having multiple cylindrically shaped conductors stacked along a common axis with a non-conductive layer separating the individual conductors, with an end conductor at the distal end of the plug. The plug is configured to mate with a corresponding receptacle jack having a cylindrical open end, with multiple tine conductors extending upwardly from a bottom closed portion of the jack towards the open end, with a bottom tine at the lower portion of the jack. The tines are arranged circumferentially around the center axis of the jack, with each tine having a slight protuberance or bump extending inwardly towards the center axis. The positioning of the protuberance along each tine corresponds to a positioning of a cylindrical conductor on the plug such that, with the plug inserted into the jack, the protuberance of each tine contacts a corresponding conductor of the plug, with the end conductor of the plug contacting the bottom tine of the jack.

Thus, with the plug inserted into the jack, the outer surface of the cylindrical conductors of the plug contact the protuberances of the corresponding tine conductors in the receptacle jack so that an electrically conductive pathway is established from each wire in the first cable—i.e., each wire of the first cable is connected to a corresponding conductor in the plug—to a corresponding wire in the second cable—i.e., each wire of the second cable is connected to a corresponding tine conductor in the receptacle jack.

This plug and jack configuration thus allows cables to be quickly and easily connected and disconnected, or plugged-in and unplugged, to and from each other. The cylindrical plug/jack arrangement is common in the audio field, with headsets, headphones, microphones, and the like having a plug that is inserted into a receptacle on a piece of equipment. This allows, for example, audio signals from the equipment to be conducted to a plugged-in headset or headphone or conducted from a plugged-in microphone to the equipment.

Headsets used with communications devices often include speakers or transducers for generating sound waves audible to a wearer as well as one or more microphones for transmitting a wearer's voice or noise from an area in proximity to the wearer. Thus, one common configuration of a plug and jack for use with a communications headset includes four conductors. Other common configurations employ five conductors, which may allow for stereo or multiple speakers, or may allow for multiple microphones, for example if used with noise cancellation circuitry. The four and five conductor jacks and plugs are substantially similar, with the five conductor jack having one more internal conductor or tine for mating with a corresponding conductor or ring on the five conductor plug.

In many cases, a piece of equipment having a four-conductor jack is functionally able to work with a headset having five conductors (and a corresponding five-conductor plug), by inserting the five conductor plug into the four conductor jack such that four of the conductors of the plug contact four conductors of the jack. For example, the fifth conductor on a headset may be used with a second microphone, while a piece of communications equipment may be configured for use with a headset having a single microphone. But for the fifth conductor on the jack, the headset would be compatible with the communications equipment.

However, while somewhat functional, the physically longer five-conductor plug cannot be reliably or safely inserted directly into the four-conductor jack. Because the five-conductor plug includes an additional conductor, it is physically longer than a similar four conductor plug and jack such that a five-conductor plug does not properly mate with a four-conductor jack. Thus, even if a five-conductor plug is inserted into a four-conductor jack, the plug does not properlysnap or lock into place and the connection is tenuous. Furthermore, attempting to fully insert a five conductor plug into a four-conductor jack will likely damage the jack and render it unusable. To avoid that problem, users must therefore rely on carrying two types of headsets, e.g., one with four conductors and one with five conductors, to ensure compatibility with various communications equipment that they may need to plug in to.

Thus, it can be seen that there remains a need in the art for a device that can safely and securely allow the use of devices having a plug with a larger number of conductors with a piece of equipment having a jack with a smaller number of conductors.

SUMMARY

Embodiments of the invention are defined by the claims below, not this summary. A high-level overview of various aspects of the invention is provided here to introduce a selection of concepts that are further described in the detailed description section below. This summary is not intended to identify key features or essential features of the claimed subject matter, nor is it intended to be used in isolation to determine the scope of the claimed subject matter. In brief, this disclosure describes a spacer and tether device for adapting a multiconductor plug for use with a multiconductor jack having a fewer number of conductors.

In one aspect, the spacer and tether device of the present invention allow adapting a multiconductor electrical plug for use with a multiconductor electrical jack having fewer conductors. The spacer fits around the body of the multiconductor plug, and physically spaces the plug away from the jack so that one or more conductors of the plug cannot be inserted into the jack. Thus, only some of the conductors of the plug are inserted into, and are in electrically communication with, the conductors in the jack.

In another aspect, the tether includes a first loop for attaching to the spacer, and a second loop for attaching around a cable of a communications device with which the space is used to keep the spacer attached and ready for use as needed.

BRIEF DESCRIPTION OF THE DRAWINGS

Illustrative embodiments of the invention are described in detail below with reference to the attached drawing figures, and wherein.

DETAILED DESCRIPTION

Figure 1:
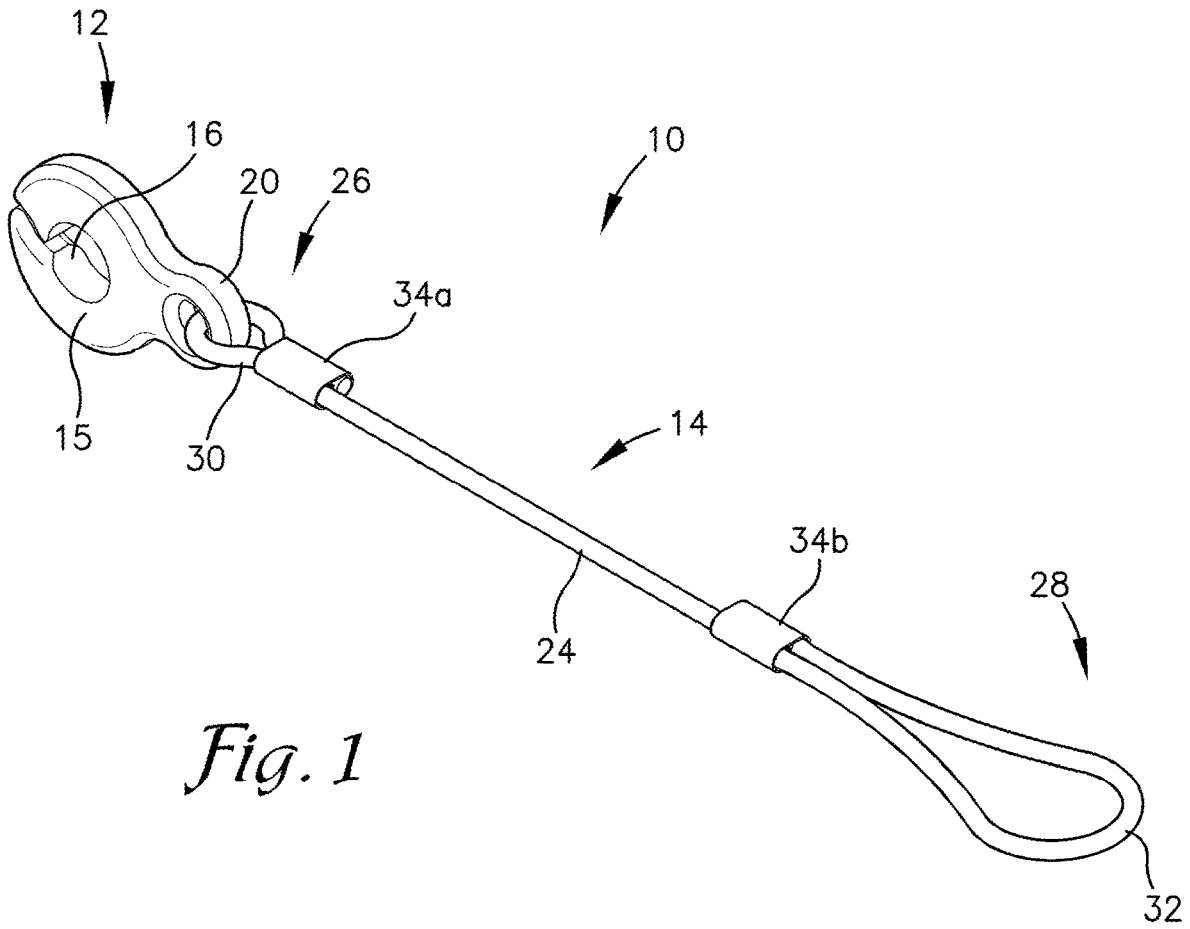
FIG. 1 is a perspective view of a spacer and tether device for adapting a multiconductor plug in accordance with an exemplary embodiment of the present invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" as used herein denote deviations from the exact value in the form of changes or deviations that are insignificant to the function.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology may be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Such terminology includes the words specifically mentioned, derivatives thereof and words of a similar import.

Figure 2:
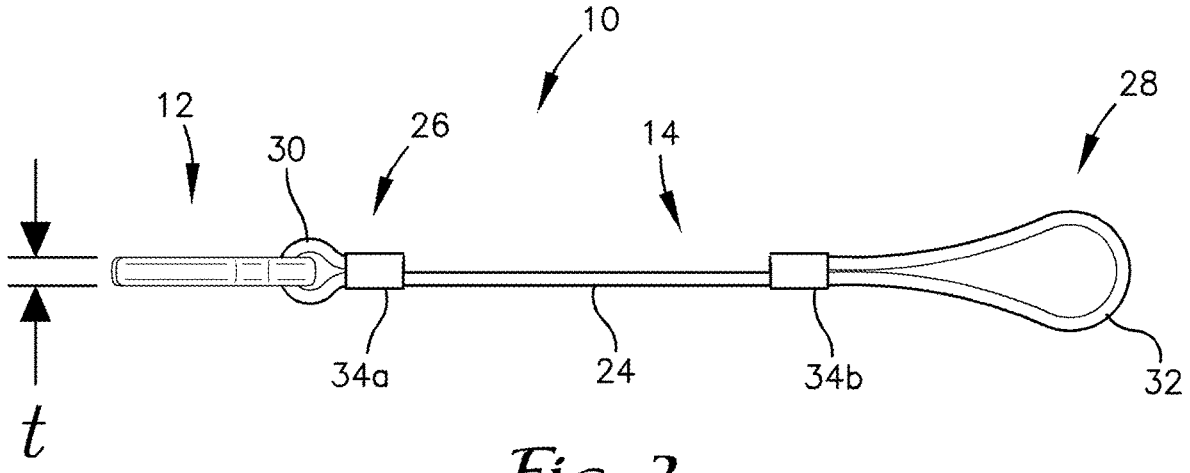
FIG. 2 is a top view of the spacer and tether device of FIG. 1.
Figure 3:
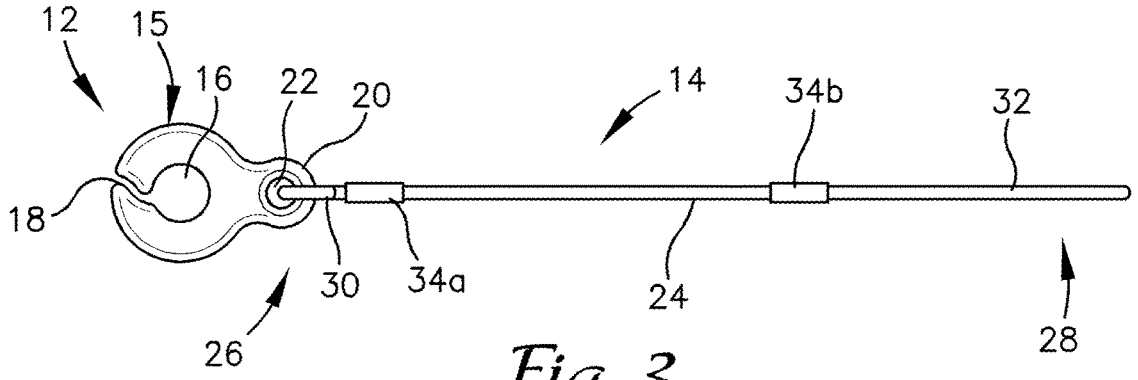
FIG. 3 is a side view of the spacer and tether device of FIG. 1.

Looking first to FIGS. 1 through 3, a spacer and tether device for adapting a multiconductor electrical plug for use with a multiconductor electrical jack in accordance with a first exemplary embodiment of the present invention is depicted generally by the numeral 10. The spacer and tether device 10 comprises an elongated tether 14, extending between first 26 and second 28 ends with a first loop 30 formed at the first end and a second loop 32 formed at the second end; and a spacer 12 attached to the first loop 30 at the first end 26 of the tether 14.

Tether 14 preferably comprises a flexible cable or cord 24, allowing first 30 and second 32 loops to be formed in the respective ends of the cord, and allowing the device 10 to flex to allow attachment to a plug as will be described in more detail below.

Spacer 12 comprises a larger, generally circular-shaped main body portion 15 having a thickness t, with a first aperture 16 formed therethrough, with a slot 18 extending from the first aperture 16 through to the outer edge of the larger main body portion 15 to allow the first aperture 16 of the spacer 12 to be fitted around a cylindrical plug. A smaller, generally circular-shaped flange 20 extends integrally outwardly from the main body portion of the spacer, with a second aperture 22 formed through the flange 20 to provide an attachment point for the spacer 12. Preferably, the thickness t of the spacer 12 is approximately equal to the height of a conductor on a multiconductor plug with which the spacer will be used when inserted into a jack, such that the plug will be offset or spaced away from the jack so that the uppermost conductor on the plug does not insert into the jack.

Flexible cable 24 is preferable made from a strong, flexible material such as twisted wire. Alternatively, cable 24 may be formed from vinyl rubber, nylon, polyester, cotton or other flexible material.

Spacer 12 is preferably formed of a resilient, flexible material, such as rubber or plastic to allow it to twist or flex. In conjunction with the resiliency of the spacer material, slot 18 formed in the spacer allows the spacer 12 to be pushed onto, or pulled from, the shaft of an electrical plug without requiring that the spacer be fitted over the end of the plug—i.e., the spacer may be pushed on over the side of the plug while the plug is partially inserted into a jack.

Looking still to FIGS. 1 through 3, first loop 30 is a smaller, tighter loop formed at the first end 26 of the tether 14, with clip 34*a* securing the returning end of the cable to the extending main portion of the cable to form first loop 30. As is apparent in the figures, first loop 30 is preferably formed by routing the end of flexible cable 24 through the second aperture 22 of the spacer 12, and routing the end of the flexible cable 24 back to attach with clip 34*a* to form the first loop 30. The first loop 30 is thus captured within the second aperture 22 of the flange 20, and the flange 20 is similarly captured within the first loop 20 such that the spacer 20 is securely attached to the first end of the tether 14.

Second loop 32 is a larger, looser loop formed at the second end 28 of the tether 14, with clip 34*b* securing the returning end of the cable to the extending main portion of the cable to form second loop 32.

First and second clips 34*a*, 34*b* are preferably clamp-type crimp clips which frictionally engage with the flexible cable to secure the cable 24 and formed loops 30, 32. In other embodiments, the loops 30, 32, may be formed by gluing, soldering, welding, or otherwise attaching the ends of the flexible cable to the main portion of the cable.

Figure 4:
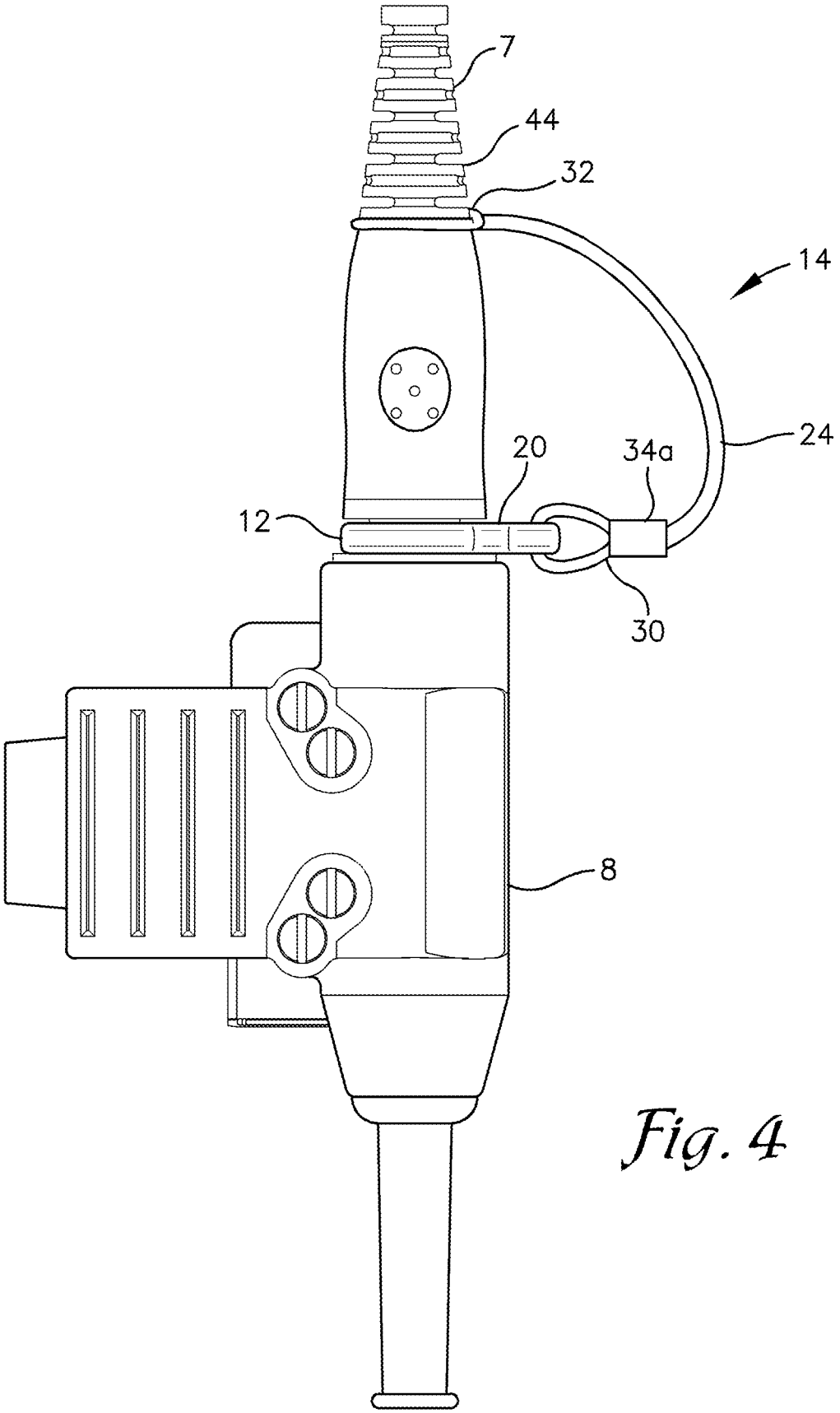
FIG. 4 is an environmental view of the spacer and tether device of FIG. 1 with the tether end attached to a multiconductor plug and the spacer in use to adapt the plug to a mating jack.
Figure 5:
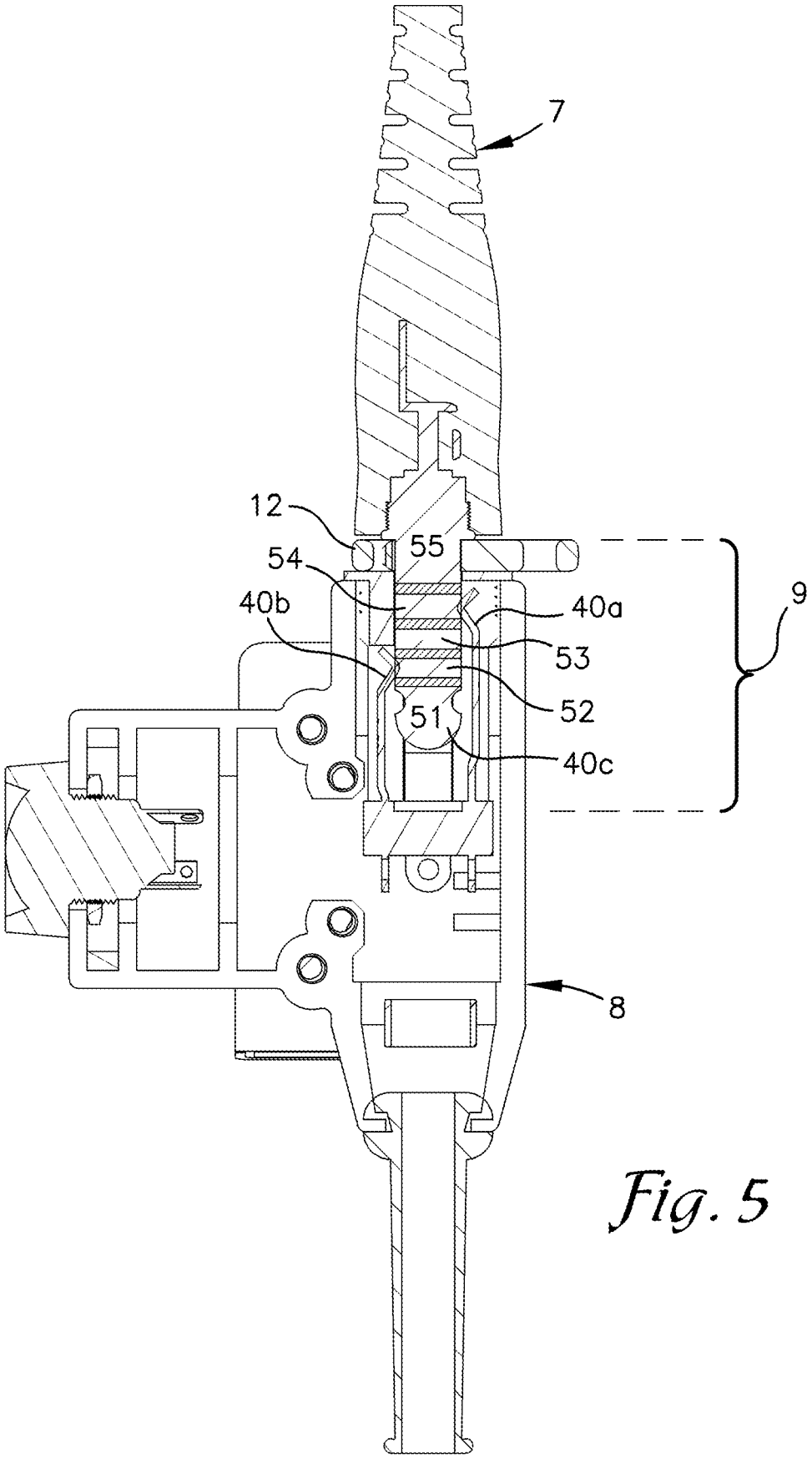
FIG. 5 is a cut-away view of the spacer and tether device and plug and jack of FIG. 4, showing the alignment of the conductors of the plug within the jack.

Looking to FIGS. 4 and 5 in conjunction with FIGS. 1 through 3, the spacer and tether device 10 as just described is depicted in use with an audio plug 7 and an audio jack 8.

As shown in FIGS. 4 and 5, audio plug 7 is multiconductor electrical plug of a type having a tip 51 and a plurality of generally cylindrically shaped conductor sleeves or rings 52, 53, 54, 55, each separated by rings of insulating material to form a plug shaft 9.

The tether and spacer device 10, as previously described with reference to FIGS. 1 through 3, includes a spacer 12 attached to a tether 14. The main body portion 15 of the spacer 12 is generally circular in shape, having a thickness t with a first aperture 16 formed therethrough. The first aperture 16 is preferably sized to conform to the outer diameter of then audio plug shaft 9 with which the device of the present invention is used, so that the spacer can be placed over the cylindrical plug shaft 9. The diameter of first aperture 16 may be formed to be slightly smaller than the diameter of the plug shaft 9 on which it is secured to provide a friction fit of the spacer 12 around the plug shaft 9 as see in the figures.

With the structure of the spacer and tether device for adapting a multiconductor plug set forth, an exemplary use of the device in adapting a five-conductor plug for use in a four-conductor jack will now be described with reference to FIGS. 4 and 5.

Looking to FIGS. 4 and 5, a four-conductor audio jack 8 of a communications device is nominally configured with four internal conductor tines (three of which are shown, 40*a*, 40*b*, 40*c*). Three of the tines extend upwardly in the cavity or receptacle of the jack (only two of the upwardly extending tines—40*a* and 40*b*—are shown in the drawing, the third upwardly extending tine is hidden by the inserted plug), and one tine 40*c* is positioned on the bottom of the jack. A five-conductor plug 7 is shown inserted into the jack 8. The plug 7 includes five conductors, numbered as 51, 52, 53, 54, and 55 in the drawing.

Spacer 12 is positioned between the plug shaft 9 and the jack 8, with the plug shaft 9 passing through the first aperture 16 in the spacer 12, and with the thickness t of the spacer 12 positioning the plug 7 slightly away from the jack 8. As can be seen in FIGS. 4 and 5, the thickness t of spacer 12 is approximately equal to the height of conductor 55 of the plug such that the spacer 12 effectively acts as an extension of the body of the jack 8 to provide a space for the fifth conductor on the plug shaft 9, allowing the remaining four conductors 51, 52, 53, 54 on the plug shaft 9 to be properly received within the jack 8.

With the plug shaft 9 thus inserted into the jack 8 through the spacer 12, the four conductors 51, 52, 53, 54, of the plug shaft 9 correctly align with the corresponding tines 40*a*, 40*b*, 40*c* (and one tine not shown in the figure) to allow electrical continuity through the conductors in the plug and jack. Thus, the spacer 12, spaces the plug shaft 9 away from the jack 8 to properly align the four conductors 51, 52, 52, 54 of the plug 7 with the four conductors of the jack to allow proper operation as if the plug 7 was a four conductor plug. The spacer 12 also prevents the plug shaft 9 from being inserted too far into the jack 8—which could cause physical damage to the jack.

As further seen in FIG. 4, the cable portion 24 of the tether 14 is attached by lower loop 30 to the eyelet 20 of the spacer 12 as described previously. The larger loop 28 of the cable 24 is attached around an outer housing 44 of the plug 7. Thus attached, the tether 14 leashes the spacer 12 to the plug housing 44 so that when not in use the spacer 12 is available for use as necessary. The device 10 can thus be attached to the plug cable of a device having a five conductor plug, allowing a user to use the five conductor plug when connecting to equipment having a five conductor jack, and also allowing the user to attach the spacer to the five conductor plug when connecting to equipment having a four conductor jack. The tether keeps the spacer attached and at the ready for use as desired.

In other embodiments, the thickness of the spacer is configured to correspond the height of a plurality of conductors on a multiconductor plug. For example, the thickness of the spacer may correlate to the height of two conductors on the plug. Thus, in use, the spacer would prevent two conductors of the plug from being inserted into a jack, and could, for example, adapt a five conductor plug for use with a three conductor jack. These and other such configurations are within the scope of the present invention.

As used herein, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A spacer and tether device for adapting a multiconductor plug, comprising:

an elongated tether extending between first and second ends; and a spacer attached to the first end of the tether, wherein the spacer has a thickness corresponding to a height of a conductor on a multiconductor plug, a first aperture formed therethrough for attachment around a multiconductor plug, and a second aperture formed therethrough for attachment of the spacer to the tether.

2. The device of claim 1, wherein the tether comprises a cable having a first loop formed at the first end and a second loop formed at the second end, wherein the first loop is attached to the spacer and the second loop is configured to attach around a cable of a communications device to secure the tether and spacer device.

3. The device of claim 1, wherein the first loop and the second loop are formed in the corresponding ends of the tether and secured by corresponding first and second clips.

4. The device of claim 1, wherein the spacer comprises a main body portion and a flange and wherein the first aperture is formed through the main body portion and the second aperture is formed through the flange.

5. The device of claim 1, wherein the spacer comprises a slot extending from the first aperture to the outer perimeter of the spacer to allow the spacer to be attached around a multiconductor plug.

6. The device of claim 1, wherein the spacer comprises a flexible, resilient material.

7. The device of claim 1, wherein the tether comprises a flexible cable.

8. A spacer and tether device for adapting a multiconductor plug, comprising:

an elongated tether extending between first and second ends, wherein the tether comprises a cable having first and second loops at the corresponding first and second ends; and a spacer attached to the first loop, wherein the spacer has a thickness corresponding to a height of a conductor on a multiconductor plug, a first aperture formed therethrough for attachment around a multiconductor plug, and a second aperture formed therethrough for attachment of the spacer to the tether.

9. The device of claim 8, wherein the first loop is attached to the spacer and the second loop is configured to attach around a cable of a communications device.

10. The device of claim 8, wherein the first loop and the second loop are formed and secured by corresponding first and second clips.

11. The device of claim 8, wherein the first and second clips comprise crimp clamps.

12. The device of claim 8, wherein the spacer comprises a slot extending from the first aperture to the outer perimeter of the spacer to allow the spacer to be attached around a multiconductor plug.

13. The device of claim 8, wherein the spacer comprises a flexible, resilient material.

14. The device of claim 8, wherein the tether comprises a flexible cable.

15. The device as in claim 1 wherein the spacer has a thickness corresponding to a height of a plurality of conductors on a multiconductor plug.

16. The device as in claim 8, wherein the spacer has a thickness corresponding to a height of a plurality of conductors on a multiconductor plug.

17. A spacer and tether device for adapting a multiconductor plug, comprising:

an elongated tether extending between first and second ends;

a spacer having a thickness corresponding to a height of a conductor on a multiconductor plug and first and second apertures formed through the spacer in spaced relationship wherein the first aperture is sized for receipt of the conductor therein for securement of the spacer around the conductor of the multiconductor plug and the tether is secured at the first end thereof to the spacer through the second aperture.

18. The device as in claim 17 wherein the tether includes a loop formed at the second end and the loop is configured to attach around a cable of a communications device to secure the tether and spacer device to the cable of the communications device.

19. The device of claim 17 wherein the spacer comprises a slot extending from the first aperture to the outer perimeter of the spacer to allow the spacer to be attached around the conductor of the multiconductor plug.

20. The device of claim 17 wherein the spacer comprises a main body portion and a flange and wherein the first aperture is formed through the main body portion and the second aperture is formed through the flange.

* * * * *